US007836646B2

(12) United States Patent
Matsufuji

(10) Patent No.: US 7,836,646 B2
(45) Date of Patent: Nov. 23, 2010

(54) WALL CONSTRUCTION OF ARCHITECTURAL STRUCTURE

(75) Inventor: Yasunori Matsufuji, Fukuoka (JP)

(73) Assignee: Japan Science and Technology Agency, Kawaguchi (JP)

( * ) Notice: Subject to any disclaimer, the term of this patent is extended or adjusted under 35 U.S.C. 154(b) by 1269 days.

(21) Appl. No.: 10/548,306

(22) PCT Filed: Sep. 4, 2003

(86) PCT No.: PCT/JP03/11288

§ 371 (c)(1),
(2), (4) Date: Sep. 6, 2005

(87) PCT Pub. No.: WO2004/079115

PCT Pub. Date: Sep. 16, 2004

(65) Prior Publication Data

US 2006/0272245 A1 Dec. 7, 2006

(30) Foreign Application Priority Data

Mar. 6, 2003 (JP) ..... 2003-060551

(51) Int. Cl.
*E04B 2/30* (2006.01)
*E04B 2/44* (2006.01)

(52) U.S. Cl. ..... 52/223.7; 52/379; 52/506.08; 52/489.1; 52/334

(58) Field of Classification Search ..... 52/474, 52/477, 48.1, 509, 508, 510, 511, 513, 326, 52/334, 479, 223.14, 223.7, 223.5, 167.1, 52/489.1, 379, 235, 506.08
See application file for complete search history.

(56) References Cited

U.S. PATENT DOCUMENTS

| | | | | | |
|---|---|---|---|---|---|
| 507,430 | A | * | 10/1893 | Graham | 52/477 |
| 839,592 | A | * | 12/1906 | Jackson | 52/781.3 |
| 1,801,541 | A | * | 4/1931 | Colean | 52/428 |
| 1,882,432 | A | * | 10/1932 | Lemerond | 52/509 |
| 2,281,951 | A | * | 5/1942 | Schroeder | 52/479 |

(Continued)

FOREIGN PATENT DOCUMENTS

JP 59-22804 Y2 7/1984

(Continued)

*Primary Examiner*—Phil Dieu Tran A
(74) *Attorney, Agent, or Firm*—Jacobson Holman PLLC

(57) ABSTRACT

A wall structure of an architecture is provided, which comprises an outer wall having resistance against earthquakes and wind and an inner wall relatively inferior in the earthquake-resistance and so forth, so that the outer and inner walls are properly combined to share design loads. The wall structure includes the outer wall (2) of bricklaying structure in which bricks (A~D) and metal plates (51) are stacked. Fasteners (60,62,63,70) extending through the bolt holes (7) of the bricks are tightened, and the vertically adjacent bricks are integrally connected with each other under prestress of the fasteners. The inner wall (3) is constructed inside of the outer wall, and the shear reinforcement member (10,20) connects the inner and outer walls with each other. The inner wall is constructed by a dry type of construction method, which can support a permanent vertical load such as a roof load. A temporary horizontal load acting on the inner wall, such as a seismic force, is transmitted to the outer wall by the shear reinforcement member.

11 Claims, 11 Drawing Sheets

U.S. PATENT DOCUMENTS

| | | | | | |
|---|---|---|---|---|---|
| 2,304,333 | A | * | 12/1942 | Bossi | 52/509 |
| 2,369,100 | A | * | 2/1945 | Young | 52/479 |
| 3,170,267 | A | * | 2/1965 | Rosenfeld | 52/105 |
| 3,958,384 | A | * | 5/1976 | Megumi | 52/477 |
| 4,009,549 | A | * | 3/1977 | Hala | 52/506.08 |
| 4,051,570 | A | * | 10/1977 | Hilfiker | 14/26 |
| 4,221,091 | A | * | 9/1980 | Ganse et al. | 52/202 |
| 4,266,890 | A | * | 5/1981 | Hilfiker | 405/286 |
| 4,607,472 | A | * | 8/1986 | Pointner | 52/698 |
| 5,207,043 | A | * | 5/1993 | McGee et al. | 52/379 |
| 5,347,781 | A | * | 9/1994 | Hanlon | 52/379 |
| 6,282,859 | B1 | * | 9/2001 | Van Der Heijden | 52/585.1 |
| 6,374,552 | B1 | * | 4/2002 | Price | 52/169.12 |
| 6,594,962 | B2 | * | 7/2003 | Pardue | 52/235 |
| 6,609,339 | B1 | * | 8/2003 | Pardue | 52/235 |
| 6,915,614 | B2 | | 7/2005 | Matsufuji | |
| 7,561,936 | B2 | * | 7/2009 | Matsufuji | 700/98 |

FOREIGN PATENT DOCUMENTS

| | | | |
|---|---|---|---|
| JP | 02-027056 | A | 1/1990 |
| JP | 05-255982 | A | 10/1993 |
| JP | 06-299621 | A | 10/1994 |
| JP | 07-229215 | A | 8/1995 |
| JP | 09-021199 | A | 1/1997 |
| JP | 09-235801 | A | 9/1997 |
| JP | 11-141018 | A | 5/1999 |
| JP | 2000-297490 | A | 10/2000 |
| JP | 2001-173240 | A | 6/2001 |
| JP | 2002-004590 | A | 1/2002 |
| JP | 2002-081152 | A | 3/2002 |
| JP | 2002-180570 | A | 6/2002 |
| JP | 2002-242449 | A | 8/2002 |
| JP | 3389552 | B2 | 1/2003 |

* cited by examiner

WALL CONSTRUCTION OF ARCHITECTURAL STRUCTURE

CROSS-REFERENCE TO RELATED APPLICATIONS

This is a nationalization of PCT/JP03/011288 filed 4 Sep. 2003 and published in Japanese.

BACKGROUND OF THE INVENTION

1. Field of the Invention

The present invention relates to a wall construction of structure, and more specifically, to such a wall construction in the structure which is provided with an outer wall of a bricklaying construction constructed in accordance with a Distributed and Unbonded Prestress (DUP) construction method.

2. Related Art

A variety of building construction methods are known in the art, such as wooden, reinforced concrete, steel and block masonry construction methods. One type of these construction methods is known as a bricklaying method, in which a wall is constructed by bricklaying. Bricks produced by baking clay at a high temperature are highly valued due to their architectural design effects or aesthetic effects resulting from their exterior wall, stately appearances, feelings, colors and so forth. The bricks also exhibit their excellent physical performances with respect to durability, sound insulation effect, fire resistance efficiency, heat accumulation effect and so forth. Therefore, the bricks have been popularly and traditionally used worldwide and widely employed for a long time as materials for architectural wall constructions.

The present inventor has proposed Distributed and Unbonded Prestress (DUP) construction method as a dry type of bricklaying construction method. This is a bricklaying construction method in which bricks are stacked in a multi-layered condition while prestress is introduced into the bricks by tightening forces of metal bolts, and studies for practical applications thereof are still continued (Japanese patent applications Nos. 4-51893, 5-91674, 6-20659, 7-172603 and 8-43014).

In general, reduction in construction costs of a house or the like is a common matter of concern for an owner, designer or constructor. Use of imported materials produced in the other countries can be considered to be effective in reduction of the construction costs. From this standpoint, housing materials produced in conformity to standards or specifications in foreign countries are imported for domestic use. These kinds of imported materials might exhibit sufficient load-carrying capacities with respect to a vertical load such as a dead load and a live load. However, in many cases, they are not in conformity to the domestic standards with regard to earthquake-resistance and wind-resistance. Therefore, it is necessary to take countermeasures, such as reinforcement of the members, or employment of members with larger cross-sections, in a case where the imported materials are to be used.

For example, as regards a conventional house, a type of construction such as a framework construction or wood frame construction is determined, and thereafter, it is designed from a design concept in which the determined construction type of structure shares both a permanent load (a dead load, a live load) and a temporary load (a seismic load, a wind load). On the other hand, with regard to structural materials such as two-by-four wooden panels designed and manufactured in conformity to the standard of an aseismic country, these materials are often inadequate for domestic standards (especially, standards of seismic countries) with respect to their strength against the seismic load, even if they can exhibit a strength against the permanent load (dead load, live load) equivalent to that of domestic structural materials. As is often the case, the imported materials cannot be employed, merely because of their insufficient strength against the temporary horizontal load.

Also in a house with brick walls, it can be considered that inner walls are constructed with the use of building materials having a relatively low strength, such as imported materials or materials manufactured at low prices, and that the inner walls are combined with outside brick walls, whereby construction costs of a house or the like are reduced. However, in a case where a conventional brick wall is constructed using a wet type method of construction, then it is difficult to share the temporary horizontal load such as a seismic force acting on the structure, even if the wall can support the dead load. Therefore, it is necessary to support the temporary horizontal load, utilizing the inner wall. However, it is difficult to obtain sufficient strength against the temporary horizontal load such as the seismic load when utilizing the inner wall which is made of construction materials manufactured in conformity to the standards and specifications of foreign countries or materials manufactured at low prices, as set forth above. Therefore, reinforcement of the inner wall, change of design thereof, or the like, is required. As the result, the construction costs are rather increased. On the other hand, it has been found from recent researches that the brick wall made by the DUP construction method can exhibit high strength against the temporary horizontal load. However, the brick wall using the DUP construction method is constructed so as to support the permanent vertical load including the load of the roof. If the brick wall further shares the temporary horizontal load, the load to be shared by the brick wall is considerably increased. Further, if the brick wall shares both of the permanent and temporary loads, the loads to be imposed on the inner wall is significantly reduced, and this results in a surplus strength of the inner wall. This is not desired from an aspect of optimization of loading balance with respect to respective structural constituents of the structure.

Further, shortening of the construction period is a common theme with respect to all kinds of architectural structures, as well as the reduction in the costs of construction. As regards the brick wall made by the DUP construction method, it is possible to significantly reduce the term of time required for the bricklaying works, in comparison to the term required for conventional bricklaying works under the wet type construction method. However, in regard to the brick walls of a bricklaying construction, it is necessary to perform interior finish work after constructing the brick walls, and therefore, the bricklaying process and the interior finishing process constitute a critical path of the whole construction schedule. In order to further shorten the construction schedule, an approach is necessary to enable simultaneity of the bricklaying process and the interior finishing process.

The brick wall made by the dry type of construction method (the DUP construction method) also allows its construction work to be carried out in a short period of time under normal weather conditions, and merits in shortening of the construction period can be achieved. However, the bricklaying processes for outer walls are apt to be affected by weather, particularly rainfall. For instance, if bad weather conditions continue for a long period of time owing to abnormal weather, a delay of the construction schedule of the bricklaying works is apprehended, regardless of the wet type of construction method or the aforementioned dry type of construction method (the DUP construction method). Therefore, it is desirable to provide a measure in which bricklaying works are enabled under circumstances unaffected by weather condition, even when bad weathers continue.

SUMMARY OF THE INVENTION

It is an object of the present invention to provide a wall construction for a structure which properly shares the permanent vertical load and the temporary horizontal load, appropriately using both the low-priced construction materials having a relatively low strength, such as imported materials, and the brick wall utilizing the dry type of construction method (the DUP construction method).

It is another object of the present invention to provide a wall construction for a structure which comprises a wall mainly sharing the permanent vertical load and a wall mainly sharing the temporary horizontal load, so that these walls can exhibit the structural strength against design loads in cooperation with each other.

It is yet another object of the present invention to improve a wall construction or a wall construction method in order to enable simultaneity in proceeding with the bricklaying work and the interior finish work, and allow the brick wall to be constructed under a circumstance unaffected by weather, using the dry type of construction method (the DUP construction method).

The present invention provides a wall construction for a structure having an outer wall of a bricklaying construction, in which bricks and metal plates are stacked and fasteners extending through bolt holes of the bricks are tightened so that the vertically adjacent bricks are integrally connected with each other under prestress of the fasteners, comprising:

an inner wall constructed inside of said outer wall, and a shear reinforcement member connecting the outer wall and the inner wall, wherein the inner wall is constructed as a wall for supporting a vertical load of a roof, an inner end portion of the shear reinforcement member is fixed to the inner wall, and an outer end portion of the shear reinforcement member is fixed to the outer wall by said fastener, whereby a seismic force acting on the roof and the inner wall is transmitted to the outer wall by means of the shear reinforcement member.

According to such an arrangement of the present invention, the wall construction for the structure is constituted from a constituent (the inner wall) sharing the permanent vertical load such as the dead load and the live load, and a constituent (the outer wall) sharing the dead load and the temporary horizontal load (the seismic load, the wind load and so forth). These constituents (the inner and outer walls) exhibit a structural strength in cooperation with each other. Such a structural concept significantly differs from that of the conventional brick wall intended to mainly take aesthetic effects (the brick wall is constructed by the wet type of construction method, outside of the inner wall which shares both the permanent vertical load and the temporary horizontal load, and the brick wall shares only its dead load.) The concept of the present invention can be obtained from findings such that the brick wall under the dry type of construction method (the DUP construction method) exhibits a high horizontal strength beyond expectation at the beginning, and such a concept cannot be obtained from the brick walls made by the wet type of construction method.

Further, according to the arrangement of the present invention, the inner walls can be constructed beforehand, and the roof can be constructed on the inner wall, and thereafter, bricklaying work for the outer walls can be performed. The bricklaying process of the outer walls is carried out under an eave of the roof, and therefore, any apprehension that the bricklaying process is delayed owing to the influence of weather can be removed. In addition, since the inner walls have been already constructed before the bricklaying process of the outer walls, the bricklaying work and the interior finish work can be performed at the same time.

Furthermore, according to the aforementioned arrangement, the temporary horizontal load acting on the roof and the inner wall is transmitted to the outer wall by means of the shear reinforcement member, and the inner wall is blocked from the wind pressure by the outer wall so that the wind pressure does not act on the inner wall. Therefore, the inner wall may have a strength that is enough to endure a permanent vertical load such as the load of a roof, and apprehensions about problems of the resistance against earthquakes and wind can be removed with respect to the imported housing materials or the low-priced materials. Thus, it is possible to construct the inner wall using imported housing materials or the low-priced materials, thereby reducing the construction costs.

Preferably, an end portion of the shear reinforcement member is secured onto the brick or secured between the vertically adjacent bricks, and it is fixed thereto by the tightening force of the fastener. The other end portion of the shear reinforcement member is tightly fixed to the inner wall. The shear reinforcement member may be composed of a bracket (21) on a side of the outer wall and a bracket (22) on a side of the inner wall wherein the former bracket (21) is secured on the brick or secured between the vertically adjacent bricks and the latter bracket (22) is tightly fixed to a component of the inner wall. In such an arrangement, the brackets on the outer and inner wall sides are connected with each other in a stress transferable condition.

The present invention also provides a wall construction for a structure having a double wall construction of an outer wall and an inner wall, wherein said outer wall has a strength for sharing a dead load of the outer wall and a temporary horizontal load acting on the outer wall and the inner wall, and said inner wall has a strength for sharing a dead load of the inner wall and a permanent vertical load acting on the inner wall; and wherein said outer and inner walls are connected with each other by a shear reinforcement member which transmits a shearing force of the inner wall to the outer wall, whereby the temporary horizontal load acting on the inner wall is transmitted to the outer wall by the shear reinforcement member.

According to such an arrangement of the present invention, the inner wall mainly sharing the permanent load and the outer wall mainly sharing the temporary load exhibit a structural strength against the design load (the temporary and permanent loads) in cooperation with each other. Therefore, two-by-four wooden panels at low prices, which do not have sufficient aseismic abilities, can be used for constructing the inner wall.

Preferably, the outer wall is a wall of bricklaying construction, in which the bricks and metal plates are stacked and the fasteners extending through the bolt holes of the bricks are tightened so that the vertically adjacent bricks are integrally connected with each other under the prestress of the fasteners.

Preferably, a temporary allowable shear force of the outer wall is in proportion to the prestress applied to the fastener. The temporary allowable shear force $Q_{AS}$ of the outer wall can be determined by the following formula:

$$QAS=t\cdot j\cdot\mu\cdot N_P/A$$

wherein t: effective thickness of the wall

J: distance between centers of tension and compression in the wall $N_p$: total amount of prestress (force) applied to the layer which causes slippage μ: the coefficient of friction between the brick and a contact surface of a metal plate (a horizontal reinforcement plate)

A: effective cross-sectional area of the wall.

Such a setting allows the brick wall constituting the outer wall to be designed as a load bearing wall having an effective aseismic ability. Further, arbitrary setting of the aseismic ability or aseismic effect of the brick wall can be carried out by appropriate setting of the prestress.

From another aspect, the present invention provides a method of constructing a wall of a structure, comprising steps of:

constructing an inner wall for supporting a load of a roof by a dry type of construction method, constructing a roof structure on the inner wall; and constructing an outer wall under an eave of the roof structure by stacking bricks and metal plates outside of the inner wall;

wherein the vertically adjacent bricks are integrally connected under prestress of a fastener with each other by tightening the fastener extending through a bolt hole of the brick, and wherein a shear reinforcement member, which transmits a temporary horizontal load acting on the inner wall to the outer wall, is provided to connect the outer and inner walls with each other when the bricks are laid up to a predetermined layer.

According to such a construction method, the bricklaying process can be performed under the eave of the roof without being affected by rainfall. Further, the interior finish work and the bricklaying work can be carried out at the same time, whereby the construction period can be shortened.

The inner wall, which has been constructed beforehand, functions as a reference or a ruler for positioning the bricks upon bricklaying, and therefore, the accuracy of bricklaying work is improved. The shear reinforcement member is fixed onto the upper face of the brick or fixed between vertically adjacent courses of the bricks by tightening force of the fastener, when the bricks are laid up to a predetermined layer. Therefore, the shear reinforcement member is fixed to the brick by the tightening force of the fastener for the bricks, without use of any particular fastener, fixing element, or the like, and the shear reinforcement member can be tightly fixed to the brick wall by the tightening force of the fastener.

As an application of the present invention, a construction method of a wall is provided, which improves resistance of an existing structure against earthquakes and wind. That is, the present invention provides a method of constructing a wall of a structure, comprising steps of:

stacking bricks and metal plates, and tightening fasteners extending through bolt holes of the bricks so as to integrally connect the vertically adjacent bricks with each other under prestress of the fastener, thereby constructing an outer wall of bricklaying construction outside of a wall of an existing structure; and connecting the existing structure and the outer wall with each other by a shear reinforcement member when the bricks are stacked up to a predetermined layer, whereby the outer wall supports a temporary horizontal load acting on the existing structure.

According to such a construction method, the temporary horizontal load acting on the existing structure is transmitted to the outer wall by the shear reinforcement member. Since the seismic force acting on the existing structure with the outer wall thus constructed is transmitted to the brick wall by means of the shear reinforcement member, the existing structure is improved in its resistance against earthquakes. Since the brick wall blocks the wind pressure which may otherwise act on the existing exterior wall, the existing structure is also improved in its wind resistance. Therefore, the existing structure, which lacks in its resistance against earthquakes and wind, is reconstructed or reinforced to have a sufficient resistance against earthquakes and wind by constructing the brick wall.

DETAILED DESCRIPTION OF THE PREFERRED EMBODIMENTS

With reference to the attached drawings, a preferred embodiment of the present invention is described hereinafter.

Figure 1:
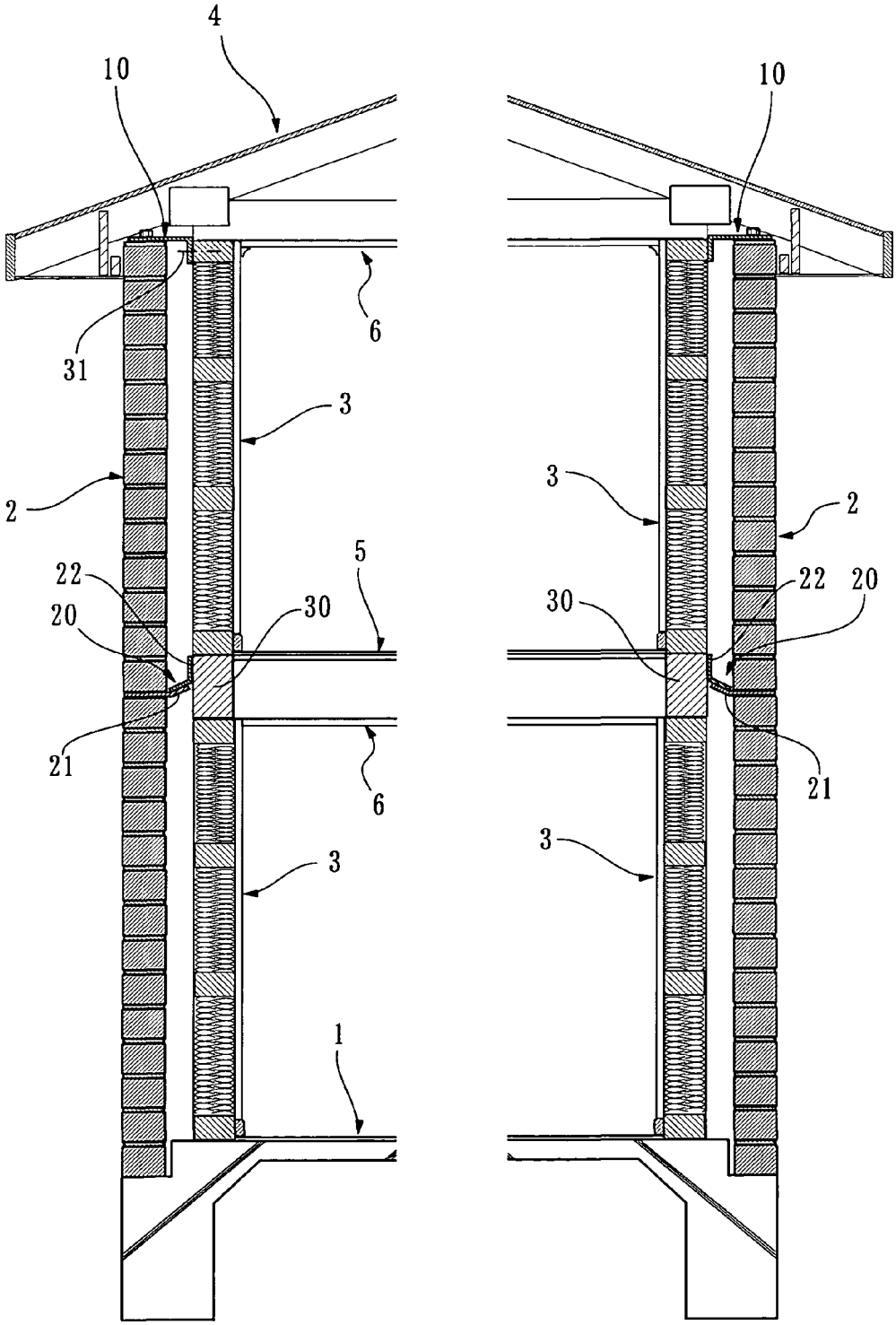
FIG. 1 is a schematic cross sectional view showing a house provided with a wall construction according to the present invention.

FIG. 1 is a schematic cross-sectional view showing a house provided with brick wall constructions in accordance with the present invention.

In general, the structure is constructed from a foundation and floor slab 1, outer walls 2, inner walls 3, a roof structure 4, a second floor structure 5 and ceilings 6. The outer walls 2 are brick walls laid on the foundation and floor slab 1 in accordance with the DUP construction method. The inner walls 3 are constructed from wooden panels which are utilized in a two-by-four method for a wooden construction, and it is built up on the foundation and floor slab 1. The roof structure 4 is supported by upper ends of the inner walls 3, and roofing materials are provided on an upper surface of the roof structure 4. The load of the roof structure 4 acts on the inner walls 3 as a vertical load, the inner walls 3 being supported by the load-carrying capacity of the inner walls 3.

Outside end portions of shear reinforcement metal parts 10 are secured to uppermost end portions of the outer walls 2, and the metal parts 10 horizontally extend toward the inner walls 3. An inner end portion of each of the metal parts 10 is bent downward at a right angle and connected to an upper end portion of the inner wall 3 by a bolt 31. A horizontal load (seismic force and so forth) acting on the roof structure 4 and the inner walls 3 is transmitted to the outer walls 2 by means of the metal parts 10 and it is supported by resistance of the outer walls 2 against earthquakes.

The second floor structure 5 and the upstairs inner wall 3 are supported by horizontal members 30, which are connected in a stress transferable condition with the outer walls 2 on an intermediate level thereof by shear reinforcement means 20. The shear reinforcement means 20 is composed of a bracket 21 on a side of the outer wall and a bracket 22 on a side of the inner wall, the bracket 21 being fixed to the outer wall 2 and the bracket 22 being fixed to the horizontal member 30. The brackets 21, 22 are integrally connected with each other by bolt-nut assemblies (not shown). The horizontal load (seismic force and so forth) acting on the inner wall 3 and the second floor structure 5 is transmitted to the outer wall 2 and supported by the resistance of the outer wall 2 against earthquakes.

Figure 2:
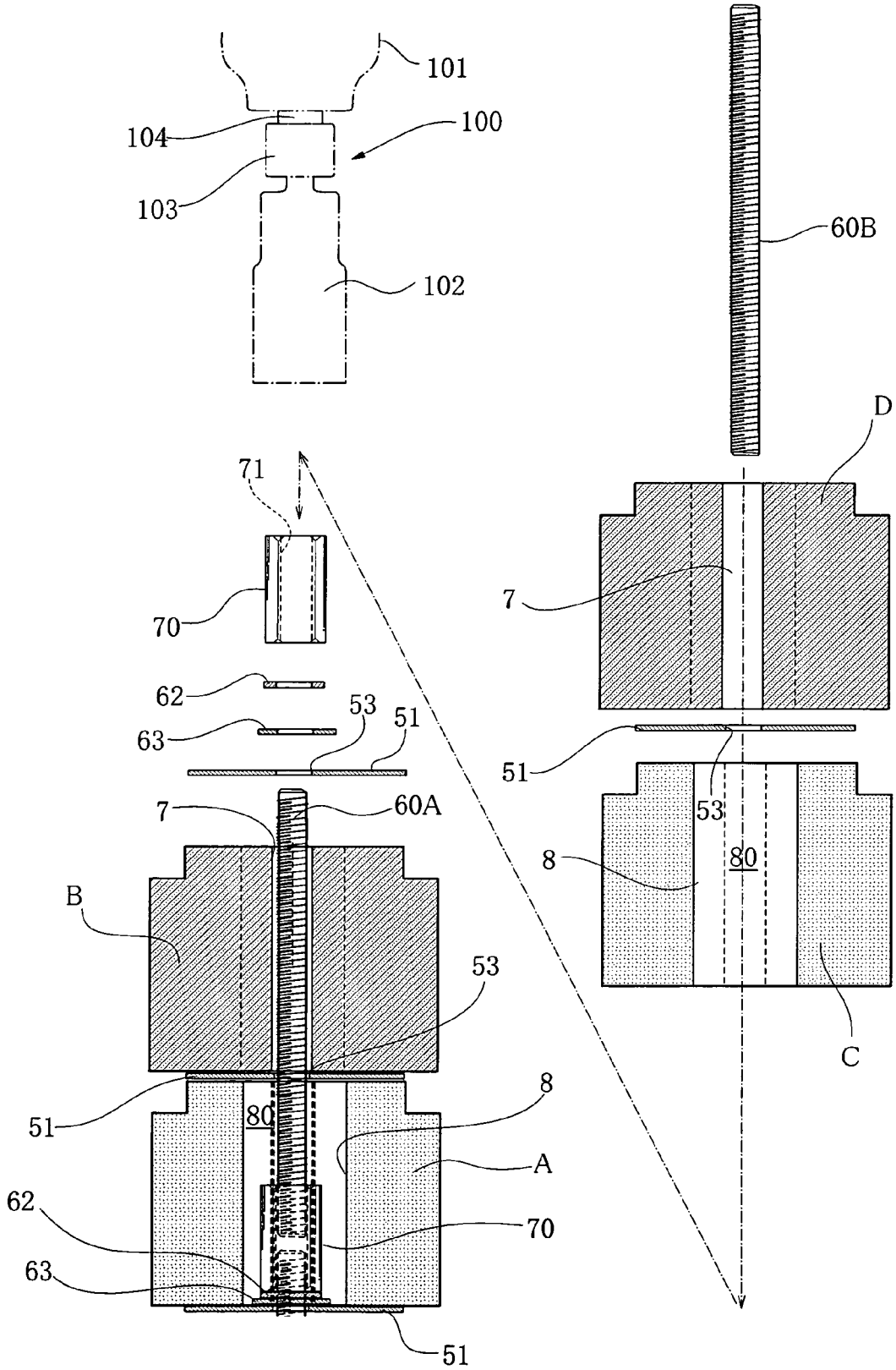
FIGS. 2 and 3 are cross-sectional views illustrating a bricklaying process of an outer wall.
Figure 3:
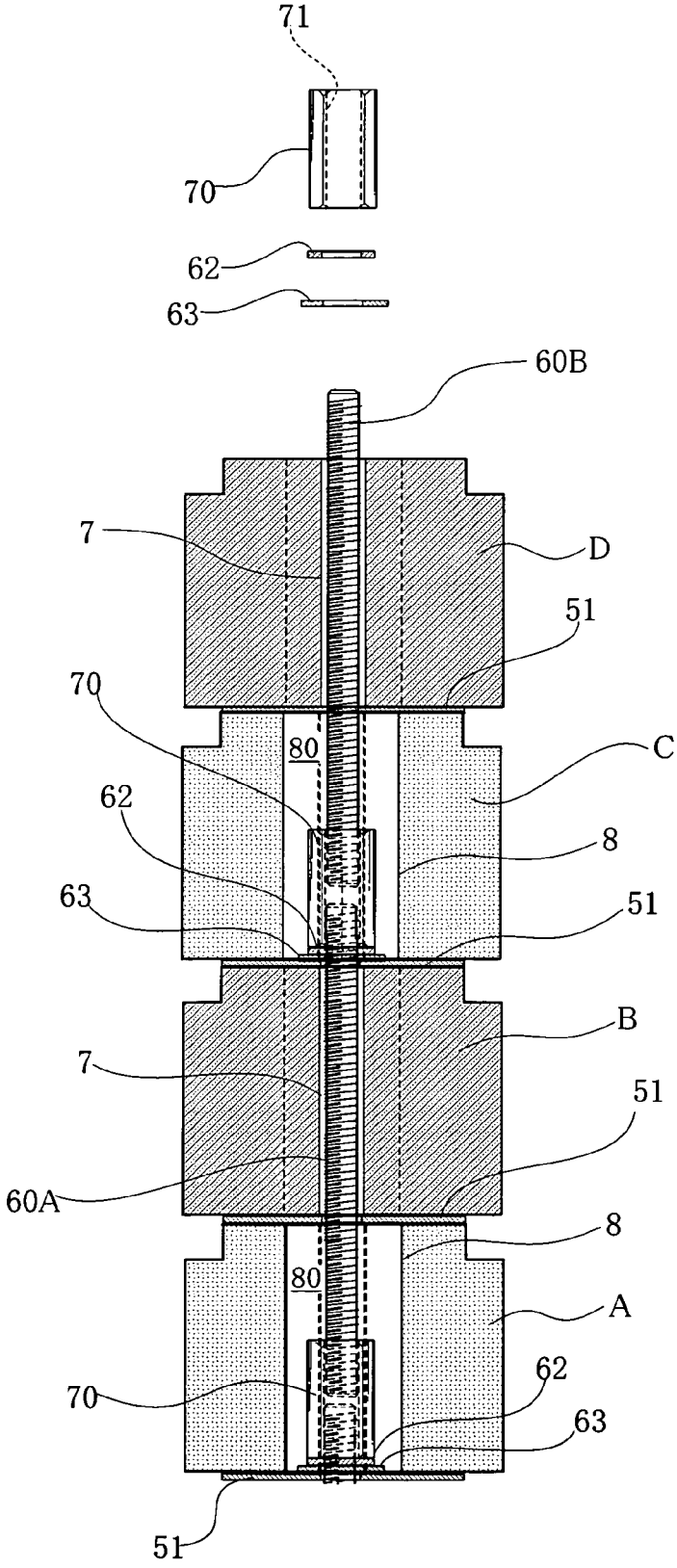
Figure 4:
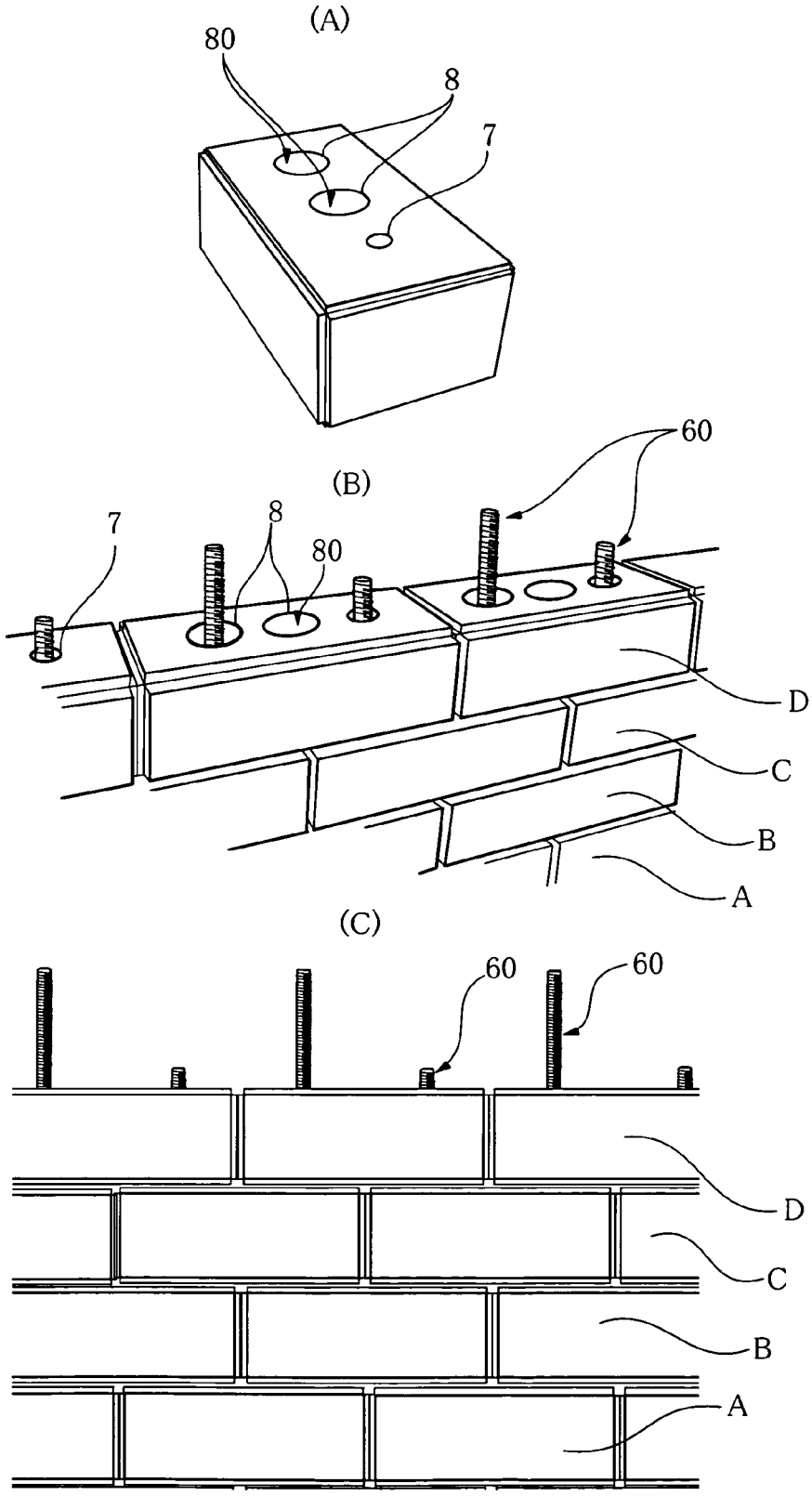
FIG. 4(A) is a perspective view of a brick.
FIGS. 4(B) and 4(C) are a perspective view and a front elevational view showing a brick-laid condition.

FIGS. 2 and 3 are cross-sectional views illustrating a brick-laying process of the outer wall. FIG. 4(A) is a perspective view of the brick, and FIGS. 4(B) and 4(C) are a perspective view and a front elevational view showing the brick-laid condition;

The bricks A:B for the outer wall 2 are vertically stacked as shown in FIG. 2, and a metal plate 51 (horizontal reinforcement plate) is interposed between vertically adjacent courses of the bricks A:B. The metal plate 51 has a width substantially equal to a width of an upper face of the brick and a length approximately equal to a length of the brick. Each of the metal plates 51 is positioned so as to extend over the adjacent two bricks. As illustrated in FIG. 4, the bricks are laid in a staggered formation, and the vertically adjacent bricks are relatively shifted along a centerline of the wall by a half size of the brick.

A bolt hole 53 of the metal plate 50 interposed between the vertically adjacent bricks A:B is in alignment with the bolt hole 7 and a through-hole 8 with a large diameter. A full screw-cut bolt 60 is inserted into the bolt hole 7, the through-hole 8 and the bolt hole 53. The bolt 60 has a height (length) equivalent to the height of two-layered bricks A:B, A long nut 70, into which the bolt 60A can be screwed, is positioned in a hollow section 80 of the through-hole 8.

The plate 51 is positioned on the upper face of the bricks A:B which have been already brick-laid. A circular washer 63 and a spring washer 62 are placed on the plate 51 in alignment with the bolt hole 53. An upper end portion of the bolt 60A extends through the bolt hole 53 and the washers 63, 62 and protrudes upwardly. The long nut 70 is screwed on the upper end portion of the bolt 60A to an extent of a lower half of an internal thread 71.

A specific fixing tool 100 as illustrated by phantom lines in FIG. 2 is used for tightening the nut 70 onto the bolt 60A. The fixing tool 100 is provided with a portable driving part 101, a socket part 102 selectively engageable with the bolt 60 and the nut 70, and a joint part 103 which can integrally connect the proximal portion of the socket 102 with a rotary shaft 104 of the driving part 101. The socket part 102 receives the nut 70 so as to transmit the torque of the part 101 to the nut 70, thereby rotating the nut 70 in its tightening direction. The nut 70 rotates relatively to the bolt 60A to be securely tightened onto the upper end portion of the bolt 60A.

In a succeeding bricklaying step, the brick C for an upper layer is further laid on the lower layer brick B. The nut 70 is contained in the hollow section 80, and the metal plate 51 is laid on the brick C, and then, the brick D of a further upper layer is laid on the plate 51. A bolt 60B is inserted into the bolt hole 7 of the uppermost brick D, and a lower end portion of the bolt 60B is screwed into the nut 70. The aforementioned fixing tool 100 is also used for tightening the bolt 60B into the nut 70. The socket part 102 of the tool 100 receives an upper end portion of the bolt 60B and transmits the torque of the driving part 101 to the bolt 60B, so that the bolt 60B is rotated in its tightening direction. This results in the bolt 60B being securely tightened into the nut 70.

The brick-laid condition of the bricks A:B:C:D thus constructed is shown in FIGS. 3 and 4. The steps of assembling the bricks, the washers 63, 62, the bolts 60 and the nuts 70 are repeatedly carried out for the upper layers above the bricks C:D, whereby a continuous vertical wall is constructed, which comprises the bricks integrally laid by means of the fastening elements 60; 62; 63; 70.

Tensile stress corresponding to the tightening torque acts as prestress on the bolt 60 screwed into its upper and lower nuts 70, whereas compressive stress acts as prestress on the brick 10 between the upper and lower plates 51. The torque applied to the bolt 60 and the nut 70 in the upper layer transfers to the bolt 60 and the nut 70 immediately thereunder, and acts to further tighten the underside bolt and nut. Therefore, a series of connected bolts 60 and nuts 70 functions in such a manner that the tightening torque of the bolts 60 and nuts 70 in the upper layer is transmitted to the bolts 60 and nuts 70 in the lower layer. Thus, the bolts 60 and nuts 70 in the lower layer are further tightened by a stronger tightening torque as the bricks 1 are laid in the upper and upper layers. Thus, a considerably enhanced prestress acts on the bolts 60 and the bricks 1 in the lower layers, so that the rigidity and toughness of the outer walls 2 are considerably improved against horizontal and vertical exciting forces.

Figure 5:
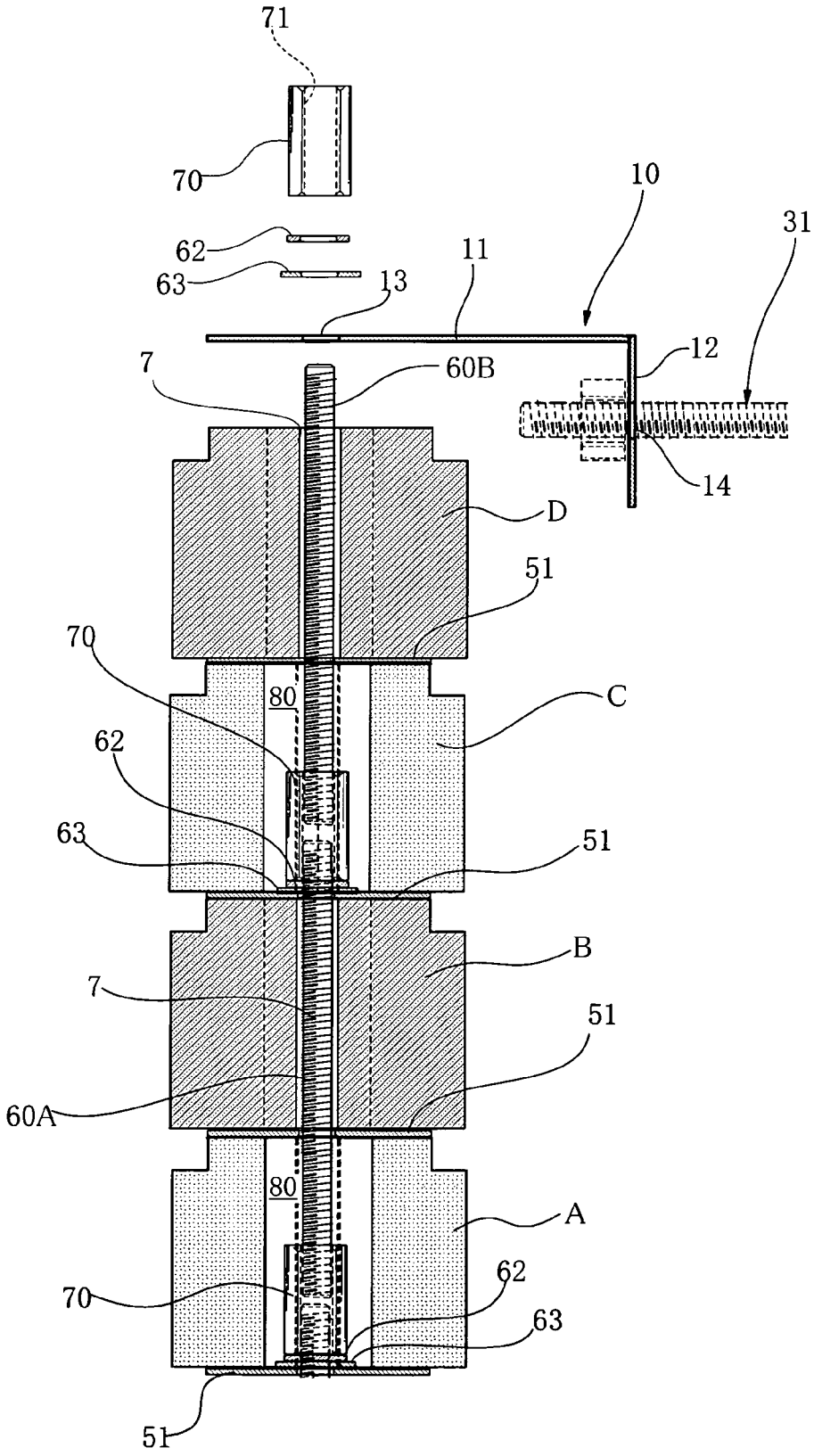
FIG. 5 is a cross-sectional view showing a structure of a shear reinforcement metal part and a way of setting of the metal part, which is positioned on the uppermost portions of the outer and inner walls.

The brick D in FIG. 5 is illustrated as an uppermost brick of the outer wall 2. The shear reinforcement metal part 10 is an integral metal plate having a horizontal portion 11 and a vertical portion 12. The horizontal portion 11 is provided with a bolt hole 13 into which the bolt 60 (60B) can be inserted. The circular washer 63 and the spring washer 62 are placed on the horizontal portion 11 in alignment with the bolt hole 13. The upper end portion of the bolt 60B extends through the bolt hole 13 and the washers 63, 62 and protrudes upwardly. The long nut 70 is screwed onto the upper end portion of the bolt 60B. For tightening the nut 70, the aforementioned fixing tool 100 is used.

The vertical portion 12 is provided with a bolt hole 14. As shown in FIG. 1, a full screw-cut bolt 31 protruding toward the outer wall is fixed to the upper end portion of the inner wall 3 on the second floor. The vertical wall 12 is positioned on an upper side face of the inner wall 3 so that the protruding portion of the full screw-cut bolt extends through the bolt hole 14 of the vertical portion 12. As shown in FIG. 5, a distal end portion of the full screw-cut bolt 31 (shown by phantom lines), which extends through the hole 14, is tightened with a nut (shown by phantom lines). The shearing reinforcement metal part 10 is integrally connected to the upper end portion of the inner wall 3 on the second floor by tightening with the nut. Thus, the upper end portions of the outer wall 2 and the inner wall 3 on the second floor are connected in a stress transferable condition with each other by the shear reinforcement metal part 10.

Figure 6:
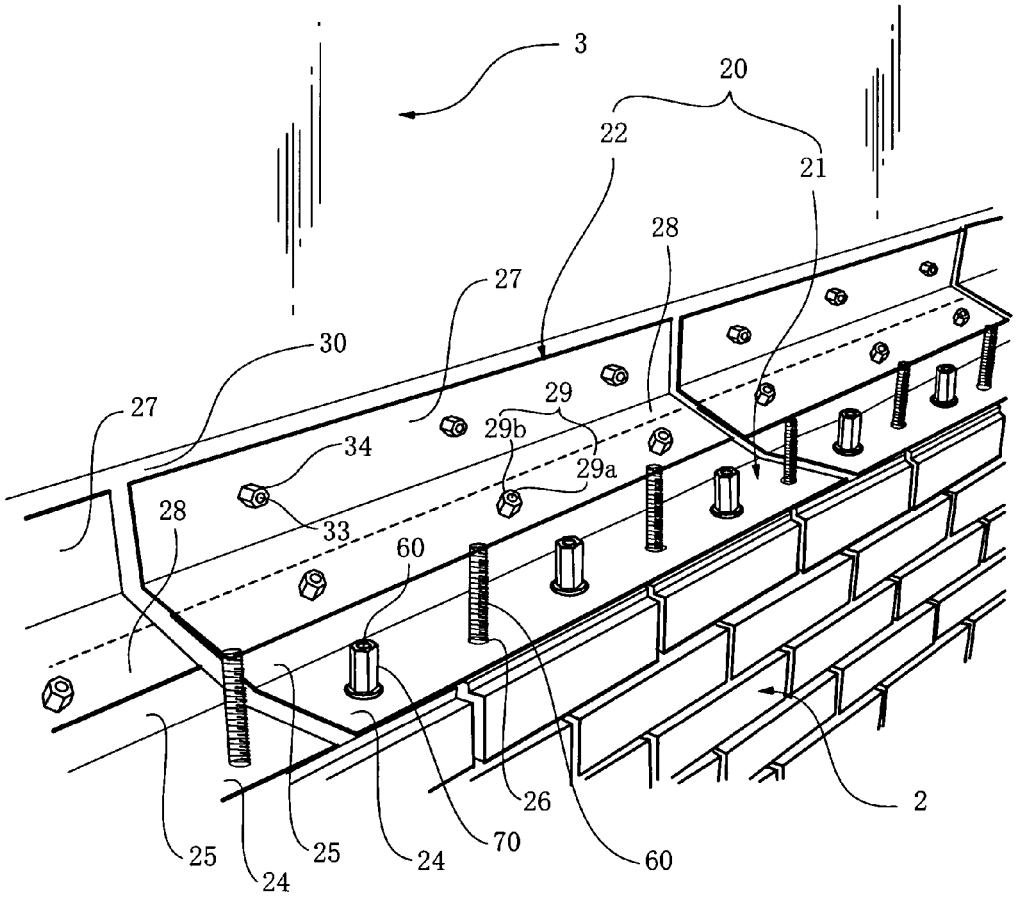
FIG. 6 is a perspective view showing an arrangement of shear reinforcement means provided on a second floor section.

FIG. 6 is a perspective view showing a structure of shear reinforcement means 20 for an intermediate floor, which is provided on a second floor section.

The shear reinforcement means 20 is located in a level equivalent to a level of the horizontal member 30, so that the intermediate portion of the outer wall 2 and the horizontal member 30 are connected in a stress transferable condition with each other. The metal bracket 21 is positioned on the upper face of the brick when the bricks are laid up to a predetermined level. The bracket 21 is constituted from a horizontal portion 24 and an inclined portion 25. The horizontal portion 24 positioned on the upper face of the bricks has an overall length such that the portion 24 extends over a plurality of bricks. The inclined portion 25 is inclined upward at a predetermined angle relative to the horizontal portion 24 and extends toward the inner wall 3. The horizontal portion 24 is provided with bolt holes 26 at predetermined intervals, through which the bolts 60 can be inserted. The upper end portions of the bolts 60 extend through the bolt holes 26 and protrude upward. The bolts 60 in predetermined positions are tightened with the long nuts 70 by means of the fixing tool 100, as previously described. The horizontal portions 24 are horizontally fixed onto the bricks by the tightening power of the nuts 70.

A vertical portion 27 of the metal bracket 22 is fixed to a side face of the horizontal member 30. Bolts 33 protruding from the side face of the horizontal member 30 extend through bolt holes (not shown) formed on the vertical portion 27. Distal end portions of the bolts 33 are tightened with nuts 34. The vertical portions 27 are integrally secured to the horizontal member 30 by the tightening power of the nuts 34 and fixed thereto in a stress transferable condition. The inclined portions 28 of the metal brackets 22 extend from lower ends of the vertical portions 27 toward the outer wall 4. An angle of inclination of the inclined portion 28 coincides with the angle of inclination of the inclined portion 25. The inclined portions 28, 25 overlap with each other in a space between the inner and outer walls 3, 2. The overlapping zone of the inclined portions 28, 25 is provided with bolt holes (not shown) at predetermined intervals, and those portions 28, 25 are tightly connected with each other by bolt-nut assemblies 29. The bolt-nut assembly 29 comprises a bolt 29*a* extending through the bolt holes and a nut 29*b* tightly screwed onto the bolt 29*a*. The bricks are further laid on the horizontal portions 24.

Thus, the inner wall 3 is connected with the outer wall 2 by the shear reinforcement metal parts 10 and the shear reinforcement means 20, so that a temporary horizontal load acting on the inner wall and the roof structure 4, such as a seismic load or a wind load, is transmitted to the outer wall by the shear reinforcement metal parts 10 and the shear reinforcement means 20. Since the outer wall 2, which is a brick wall made by the DUP (Distributed and Unbonded Prestress) construction method, has sufficient strength to resist against the temporary horizontal load, the inner wall 3 may merely share a horizontal load.

Figure 7:
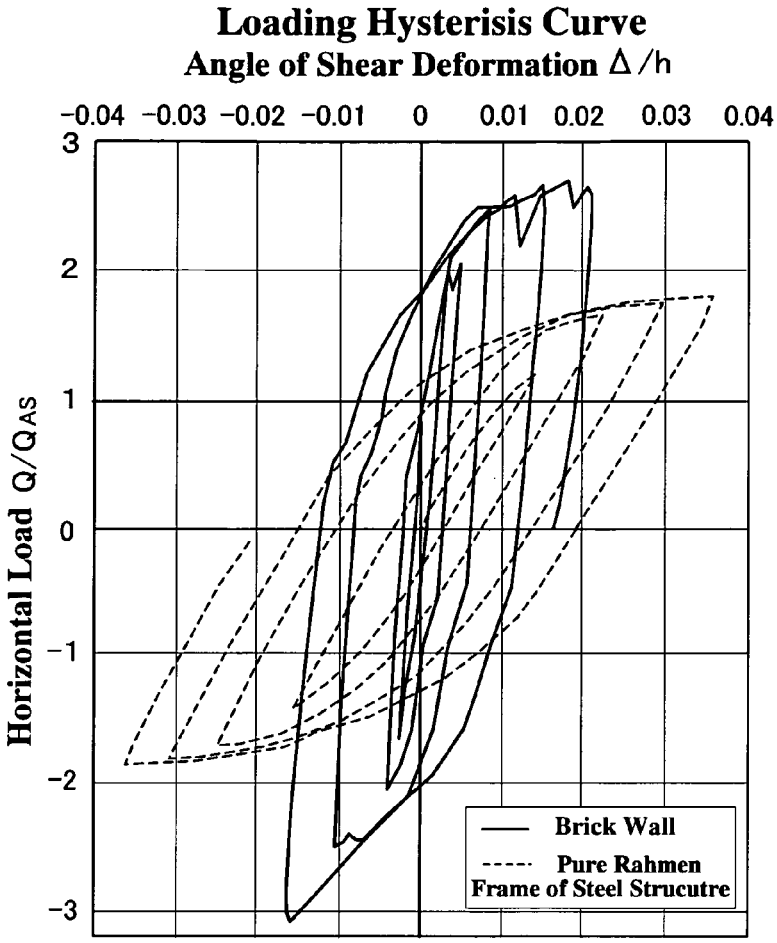
FIG. 7 is a diagram showing results of a loading test (loading hysteresis curve) with respect to a brick wall made by the DUP construction method.

FIG. 7 is a diagram showing results of a loading test (loading hysteresis curve) with respect to the DUP brick wall which constitutes the outer wall 2. The loading hysteresis curves as shown by solid lines in FIG. 7 represent relations between the horizontal load acting on the brick wall and the angle of shear deformation. In the diagram of FIG. 7, loading hysteresis curves of a pure Rahmen frame of steel structure is depicted as a comparative example by dotted lines. In the diagram of FIG. 7, an axis of the ordinate indicates $Q/Q_{AS}$ which is a ratio of the in-plane horizontal load Q to the temporary allowable shear force $Q_{AS}$, and an axis of the abscissa indicates the angle of shear deformation. The brick wall used in the experiment was constructed with use of steel bolts M12, and the prestress of 7.0 kN per bolt was equally applied to each of the bolts.

As shown in FIG. 7, the loading hysteresis curves of the brick wall are, in general, analogous to the loading hysteresis curves of the steel structure, the curves representing steady fusiform loops. It is considered that this results from occurrence of slippage between the brick and the metal plate, which compensates the temporary horizontal load such as the seismic force inside of the dry-materials structure composed of the bricks and the plates. Such slippage allows the wall to flexibly respond to the temporary horizontal load, whereby total destruction or collapse of the wall can be prevented from occurring. That is, the brick wall exhibits high energy-absorption properties and possesses a strength against the considerable seismic force so as to prevent the wall from being totally destroyed or collapsed. In order to ensure a sufficient safety factor with respect to the ultimate strength, the temporary allowable shear force of the brick wall is set to be in such a condition that occurrence of a plastic deformation due to the slippage is not permissible ($Q/Q_{AS} \leqq 1$).

The formula for analyzing the shear unit stress and the angle of deformation, which is used for design of the brick wall, is as follows:

$$\Theta=\{(H\cdot H_m^2/2E_wI_w-h_m^3/6E_wI_w)\cdot A/H+1/G\}\tau$$

Θ: angle of shear deformation of the wall

τ: shear unit stress

A: effective cross-sectional area of the wall

H: height of the wall $h_m$: level of a measured point

G: shear elastic modulus of the dry-materials structure (the structure composed of the bricks, plates, bolts and nuts)

wherein $E_wI_w=E_bI_b+EI$ $E_b$: Young's modulus of the bolt

E: Young's modulus of the dry-materials structure $I_b$: moment of inertia for all bolts I: moment of inertia for total cross-sectional area of the dry-materials structure.

The proportion of the temporary horizontal load shared by each of the walls of the structure depends on the angle of shear deformation caused in response to the shearing unit stress, and so forth. The design temporary shearing force (in-plane sharing) of each of the walls, which corresponds to the design seismic force for the design of the structure, is determined, based on the ratio of its share of the temporary horizontal load.

The formula for design with respect to the in-plane shearing of the DUP brick wall is as follows:

$$_DQ_s/Q_{AS} \leqq 1 \quad (1)$$

$_DQ_s$: design temporary shearing force of the wall $Q_{AS}$: temporary allowable shear force of the wall (strength against shearing in the critical state against damage).

"$Q_{AS}$" (temporary allowable shear force is obtained by the following formula (2) (in a case of wall without opening):

$$Q_{AS}=t\cdot j\cdot f_s \quad (2)$$

t: effective thickness of the wall j: distance between centers of tension and compression in the wall $f_s$: temporary allowable shearing unit stress of the wall (strength against sharing in the critical state against damage)

wherein j=7d/8 ("d" is the distance between an end of the wall on its compression side and the center of vertical reinforcement element (the center of the bolt) in an end of the wall on its tension side).

"$f_s$" (temporary allowable shearing unit stress) depends on the prestress applied to the bolt and obtained by the following formula (3):

$$f_s=\mu N_p/A \quad (3)$$

$N_p$: total amount of prestress (force) applied to the layer which causes slippage μ: the coefficient of friction between the brick and a contact surface of the horizontal reinforcement plate (metal plate)

A: effective cross-sectional area of the wall

Figure 8:
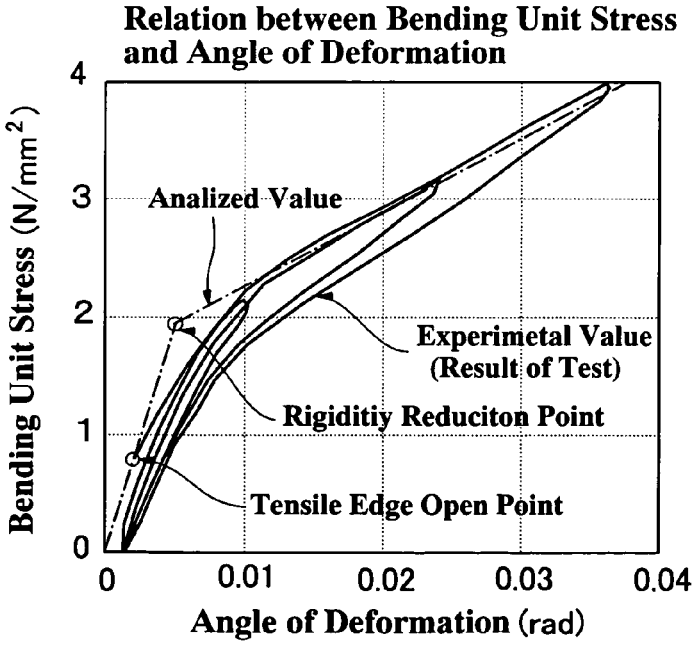
FIG. 8 is a diagram showing results of a test of an out-of-plane rigidity (results of an out-of-plane test) with respect to the brick wall made by the DUP construction method.

FIG. 8 is a diagram showing results of a test of an out-of-plane rigidity (results of an out-of-plane bending test) with respect to a brick wall constituting the outer wall 2. In FIG. 8, bending unit stress is shown, which acts on the brick wall as a result of the horizontal load perpendicularly acting on the brick wall at a right angle.

As the load, e.g., the wind load, perpendicularly acting on the brick wall in an out-of-plane direction is increased, the wall starts to cause a bending deformation, so that a narrow gap is formed between the vertically adjacent bricks on the wall face of the tension side (tensile edge open point). In a case where the bending stress exceeding this point acts on the inside of the wall, inclination of the curve representing the relation between the angle of deformation and the bending unit stress is reduced after it exceeds a rigidity reduction point. The curve shows a tendency similar to that of the relation between the angle of deformation and the bending unit stress in a plastic deformation range. However, release of the load in the out-of-plane direction causes the wall to return to its initial state, and its residual strain and residual deformation are slight. This results from the prestress applied to the bolt. The results of such experiments repeatedly conducted show that the brick wall undergoes substantial elastic deformation to a marked extent of the deformation angle in response to the temporary horizontal load acting thereon in the out-of-plane direction, such as wind pressure. Thus, it is found that, if an action is added which appropriately transmits the load from this brick wall to another brick walls or the like located perpendicularly thereto, the outer wall can be designed so as not to cause the wall to be totally collapsed or destroyed by seismic force, wind pressure or the like in the out-of-plane direction.

FIGS. 9 to 16 are perspective views schematically illustrating steps of construction of a two-story house.

Figure 9:
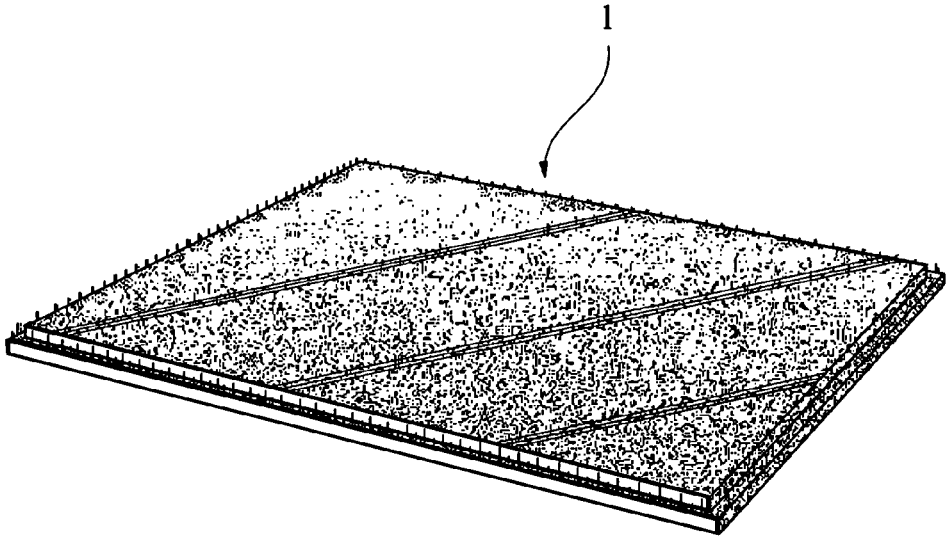
FIG. 9 is a perspective view showing a process of construction of a two-story house, in which a process of construction of foundation and first floor base structure is illustrated.
Figure 10:
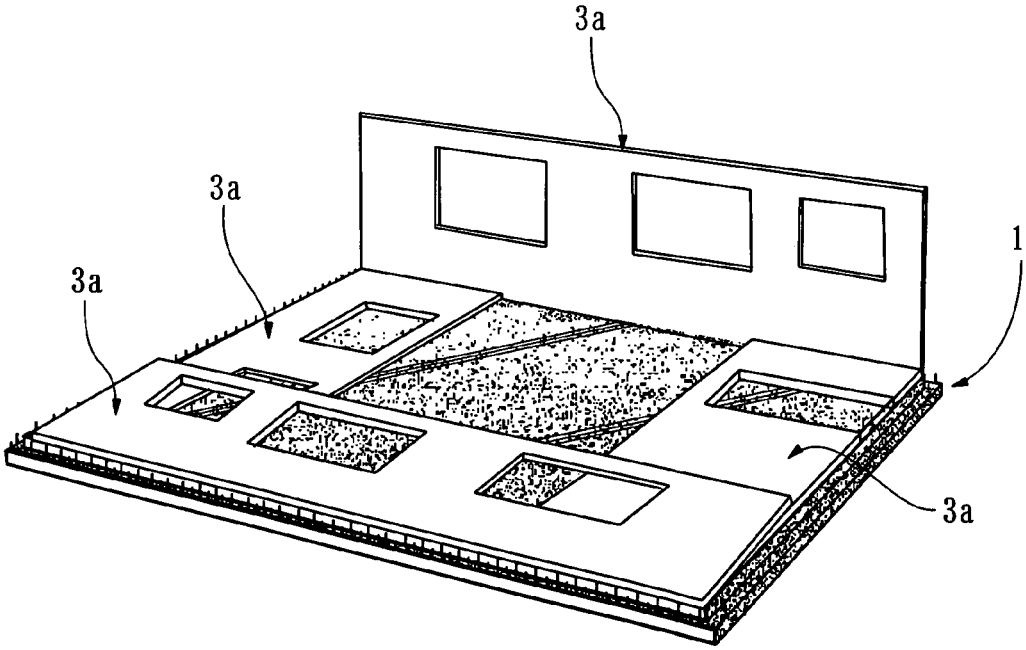
FIG. 10 is a perspective view showing a built-up process of the inner walls on the first floor.
Figure 11:
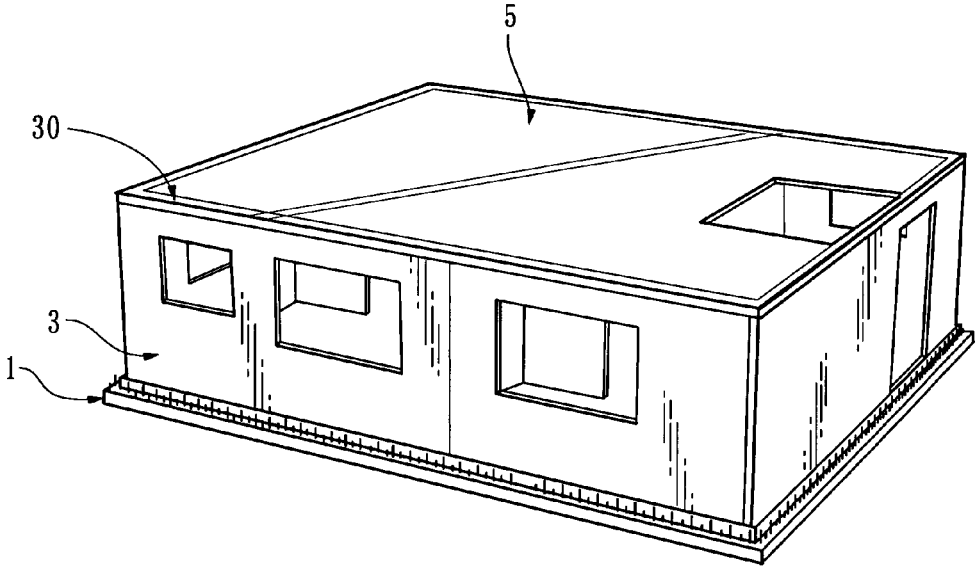
FIG. 11 is a perspective view showing a process of construction of a second floor structure.
Figure 12:
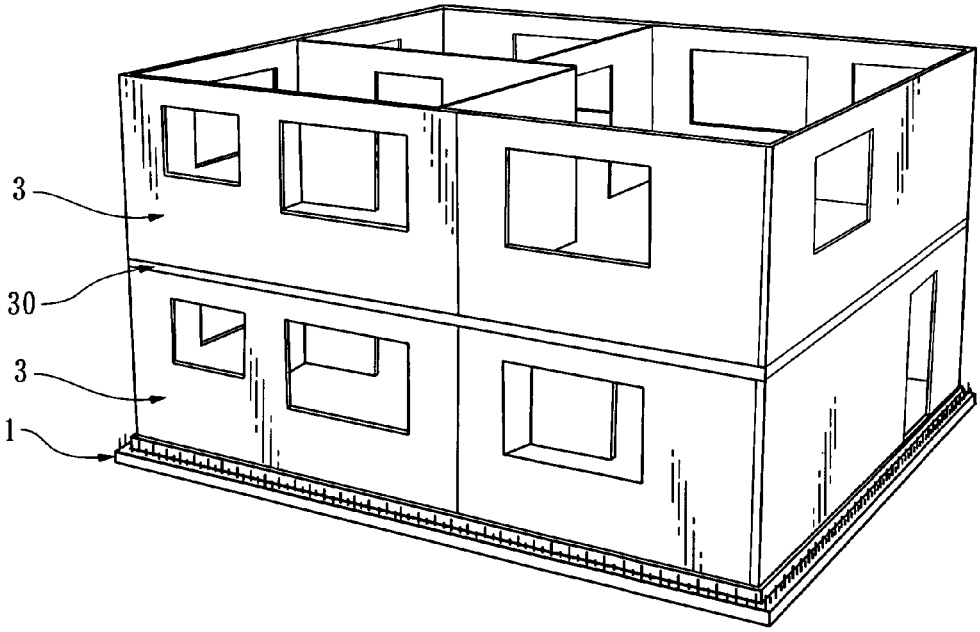
FIG. 12 is a perspective view showing a process of construction of the inner walls on the second floor.
Figure 13:
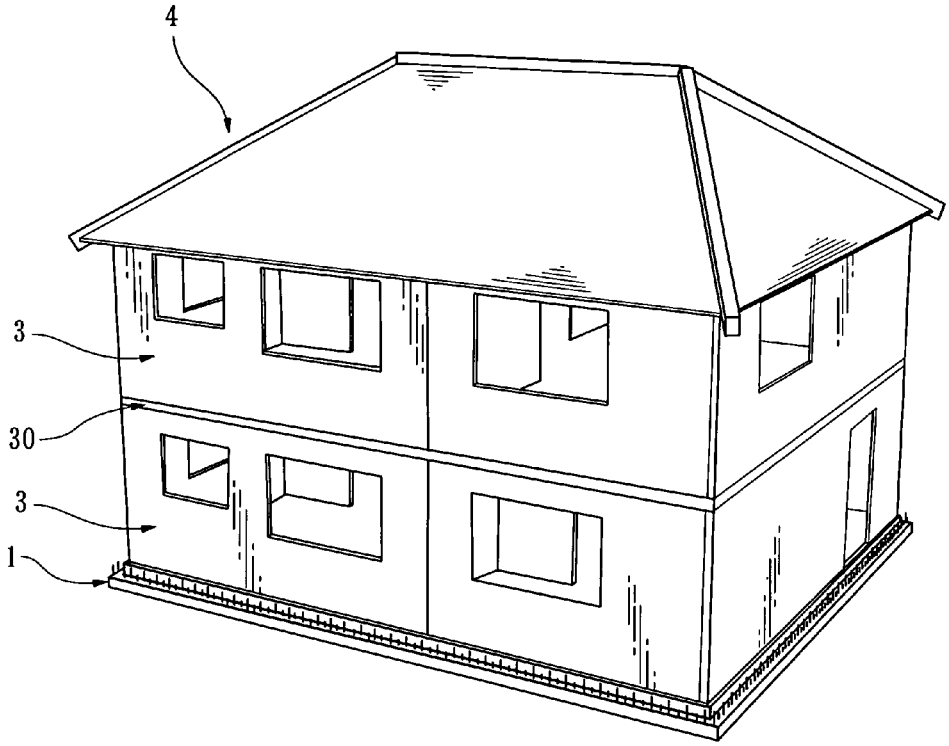
FIG. 13 is a perspective view showing a process of roofing work.

In a structure where the wall construction is in accord with the present invention, the inner wall 3 is constructed before the brick wall constituting the outer wall 2 is constructed, as shown in FIGS. 9 to 16. At the step of constructing the foundation and floor and the step of constructing the inner wall on the first floor as illustrated in FIGS. 9 and 10, the foundation and floor slab 1 are constructed, and thereafter, the wooden panels 3*a* constituting the inner walls 3 of the first floor are successively built up on the foundation and floor slab 1. Then, the second floor structure 5 is constructed and the inner wall 3 of the second floor is built up by wooden panels similar to those of the inner wall on the first floor, as shown in FIGS. 11 and 12. Further, the roof structure 4 and the roof are constructed on the inner wall 3 of the second floor, as shown in FIG. 13. The inner wall 3 has a load-carrying performance (a durability against a vertical load) sufficient enough to endure the vertical load, and therefore, the structures made by the inner wall 3, the roof structure 4 and the floor structure 5 of the second floor are transitionally stable.

Figure 14:
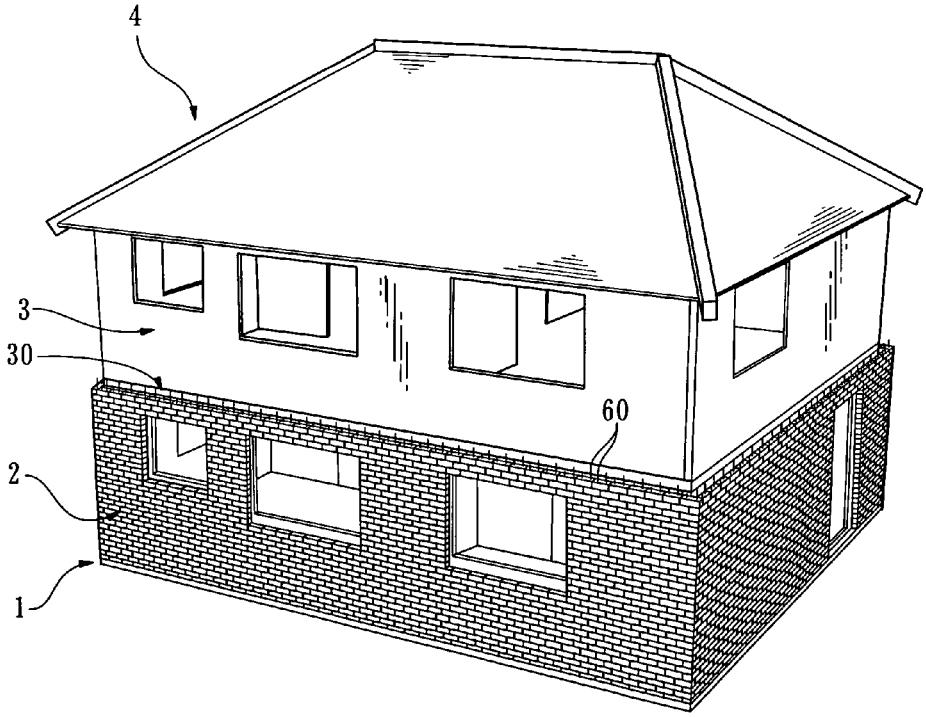
FIG. 14 is a perspective view showing a bricklaying process for the outer walls of the first floor.

As shown in FIG. 14, the bricks for the outer wall 2 are laid on the outer peripheral zone of the foundation and floor slab 1 in accordance with the DUP construction method as previously described. Since the roof structure 4 has been already constructed, the bricklaying work can be carried out without being affected by weather and it is unnecessary to protect the bricks against rainwater. The bricklaying work is performed under circumstances below eaves where the work is not affected by a rainfall, and therefore, it is possible to avoid a delay of schedule of the bricklaying work owing to the rainfall. Further, since the inner walls 3 have been already constructed, an interior finish work, such as an interior finishing board work, can be carried out simultaneously with the step of bricklaying work for the outer walls 2. Thus, the construction period can be shortened by performing the bricklaying step and the interior finish step at the same time.

Figure 15:
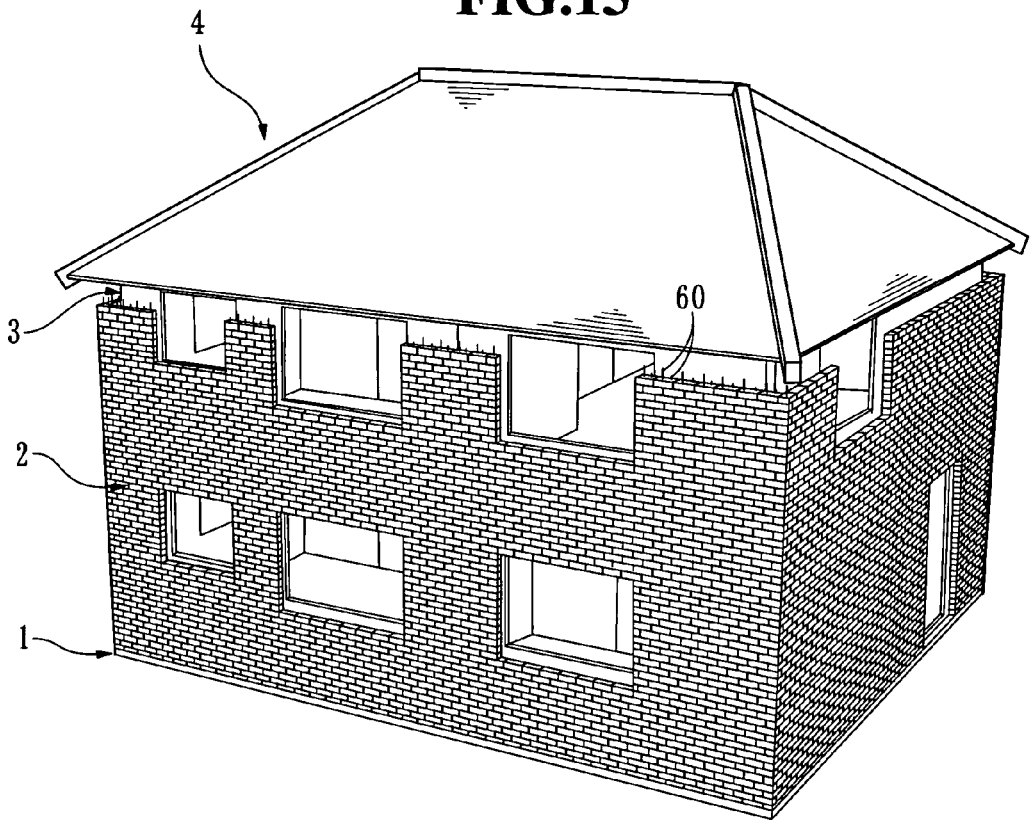
FIG. 15 is a perspective view showing a bricklaying process for the outer walls of the second floor.

As illustrated in FIG. 14, the shear reinforcement means 20 (FIG. 6) as previously described is provided when the bricklaying work of the outer wall 2 on the first floor is finished up to the second floor level. The outer wall 2 and the inner wall 3 are connected with each other by the shear reinforcement means 20. Thereafter, bricklaying work for the outer wall 2 of the second floor is carried out, as shown in FIG. 15. At a stage of bricklaying the bricks at the uppermost layer, the upper end portion of the outer wall 2 is connected with the upper end portion of the inner wall 3 by the shear reinforcement metal parts 10 (FIG. 5). Thus, the outer walls 2 are constructed on the periphery of the structure.

According to such an arrangement, the inner wall 3 supports the dead load of the inner wall 3, the load of the roof structure 4, the load of the second floor, the live load of the structure, and so forth. The seismic force acting on the inner wall 3 is transmitted to the outer wall 2 through the shear reinforcement metal parts 10 and the shear reinforcement means 20, and supported by the outer wall 2. Further, the wind pressure does not act on the inner wall 3 since the outer wall 2 blocks the wind pressure, which may, otherwise, acts on the inner wall 3. Therefore, since the inner wall 3 may share only the vertical load, the wooden panel with a relatively low strength, which lacks in aseismic strength and wind resistance, can be used for construction of the inner wall 3.

Further, the arrangement according to the present invention is applicable to reconstruction or reinforcement of existing structures which lack in aseismic strength and wind resistance. Normally, the structure exists in a state that its walls share both the permanent loads such as dead load and live load, and the temporary load such as seismic force and wind pressure. However, the existing structure is deteriorated for long-term use, and its strength is decreased. Further, many structures constructed in the past have often been provided with insufficient strength against earthquakes and wind, compared to recent structures. Assuming that the walls 3 and the roof structure 4 as shown in FIG. 13 are walls and a roof of an existing structure, an application of the present invention is described hereinafter, wherein the arrangement of the present invention is applied to reconstruction of the existing structure.

Figure 16:
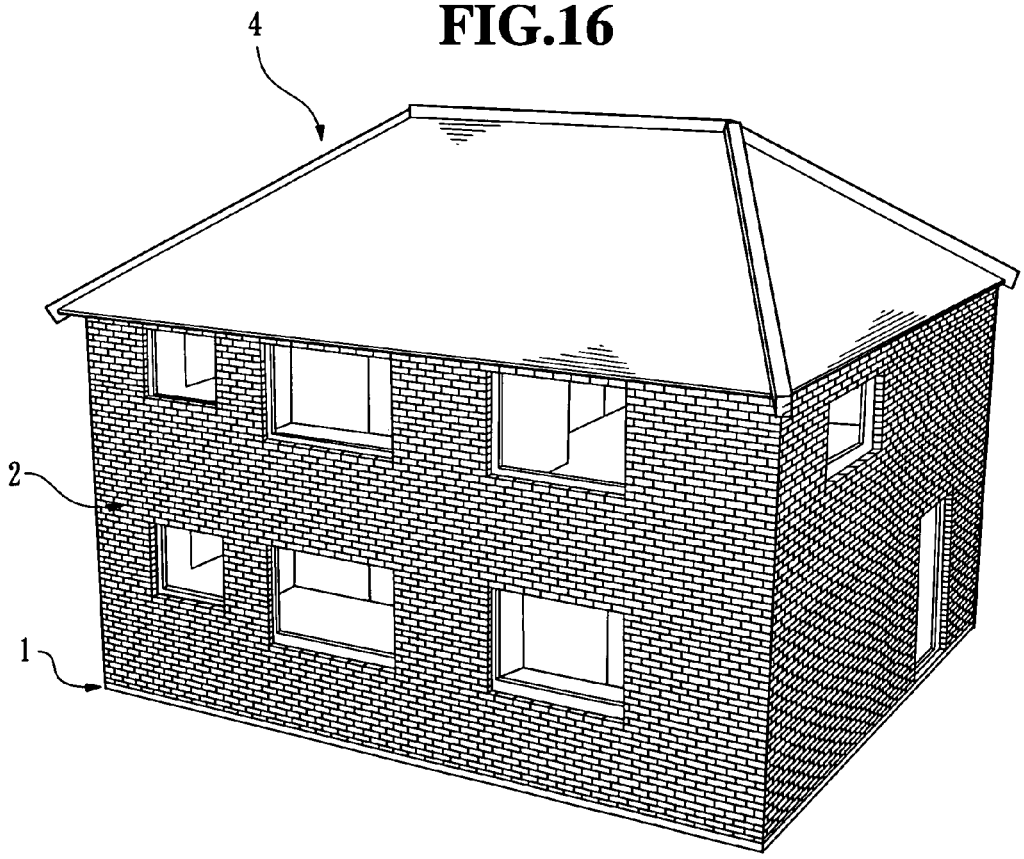
FIG. 16 is a perspective view showing a condition in which the bricklaying work is completed.

In the existing structure as shown in FIG. 13, the existing walls 3 support the permanent vertical load, such as the dead load of the walls 3 themselves, the load of the roof structure 4, the load of the second floor and the live load, and further, the walls 3 support the temporary horizontal load, such as the seismic force and the wind load. In order to reduce the temporary horizontal load acting on the structure, the outer walls 2 of the bricklaying construction is newly constructed outside of the structure in accordance with the DUP construction method. Specifically speaking, the foundation 1 for supporting the lowermost layer of the bricks is constructed along the lower end of the existing walls 3 as shown in FIG. 13, and the outer walls 2 of the bricklaying construction is built up as illustrated in FIGS. 14, 15 and 16. In the process of constructing the outer walls 2 as shown in FIGS. 14 and 15, the shear reinforcement metal parts 10 and the shear reinforcement means 20 are installed on the brick walls 2, and the existing walls 3 are connected with the outer walls 2. A seismic force acting on the existing walls is transferred as stress to the newly constructed outer walls 2 by the shear reinforcement metal parts 10 and the shear reinforcement means 20, and supported by the outer wall 2. The wind pressure does not act on the existing walls 3, since the outer walls 2 block the wind pressure which may, otherwise, act on the existing walls 3. Therefore, the existing structure with the outer walls 2 thus constructed is released from the temporary horizontal load such as the seismic force and the wind pressure, and the structure may merely support the permanent load. Thus, the existing structure is reinforced by constructing the outer walls 2 of a bricklaying construction.

Although the present invention has been described as to a preferred embodiment, the present invention is not limited thereto, but may be carried out in any of various modifications or variations without departing from the scope of the invention as defined in the accompanying claims.

For insurance, the shear reinforcement metal parts 10 and the shear reinforcement means 20 may be further provided in a level between the second floor level and the roof structure level, or in a level between the second floor level and the foundation level.

Further, the bolt holes of the shear reinforcement metal parts 10 and the brackets 21,22 can be designed to be loose holes or slots for workability of installation of the parts 10 and the brackets 21,22; relative movements of the parts 10 and the brackets 21,22 to the walls 2,3; movements of the brackets 21, 22 relative to each other; and so forth.

INDUSTRIAL APPLICABILITY

According to the present invention, a wall construction of a structure can be provided, which appropriately uses both the brick wall utilizing the DUP construction method and the relatively low-strength or low-priced construction materials, such as materials of foreign specifications or low-priced specifications. The brick wall that uses the DUP construction method has a resistance against earthquakes and wind enough to share the temporary horizontal load acting on the structure, differently from the conventional brick wall. Since the brick wall made by the DUP construction method shares the dead load and the temporary horizontal load, the inner wall may share the dead load and the permanent vertical load. Therefore, it is possible to construct the inner wall with use of imported housing materials or low-priced materials, thereby reducing the construction costs.

Further, according to the wall construction or the construction method of the present invention, the construction period can be shortened by simultaneously proceeding with the bricklaying work and the interior finish work. In addition, the bricklaying process can be carried out under circumstances situated beneath the eave of the roof structure without being affected by weather.

Furthermore, the wall construction according to the present invention is applicable to any type of wall construction. In such a case, the outer wall has strength for sharing its dead load and the temporary horizontal load acting on the outer and inner walls, whereas the inner wall has strength for sharing its dead load and the permanent vertical load acting on the inner wall. The load of the roof and upper floor and the permanent vertical load such as a live load are supported by the inner wall. The seismic load acting on the inner wall is transmitted to the outer wall by means of the shear reinforcement member and supported by the outer wall. Further, the wind load merely acts on the outer wall. Thus, the inner and outer walls exhibit the structural strength against the design load in cooperation with each other, and particularly, the seismic or wind load, i.e., the temporary horizontal load does not act on the inner wall, and therefore, the inner wall can be constructed with the use of relatively low-strength or low-priced construction materials, such as the materials of foreign specifications or low-priced specifications.

The invention claimed is:

1. A wall construction for a building structure having a roof and a foundation for defining an internal space of the building structure, the wall construction comprising:

an outer wall sharing its own dead load and built on the foundation of the structure, wherein the outer wall has a Distributed and Unbonded Prestress bricklaying construction in which bricks and metal plates are stacked, the bricks and the metal plates have bolt holes therein, fasteners extend through the bolt holes in the bricks and the bolt holes of the metal plates, and the fasteners are tightened so that vertically adjacent bricks are integrally connected with each other under prestress of the fasteners, each of the metal plates being interposed between upper and lower vertically adjacent bricks to be in contact with an upper face of the lower brick and a lower face of the upper brick under the prestress;

an inner wall sharing its own dead load and constructed to support a vertical load of the roof, wherein the inner wall defines the internal space in conjunction with the roof and the foundation; and a shear reinforcement member made of a metal plate extending along the inner and outer walls, wherein the shear reinforcement member connects the outer wall and the inner wall with each other and transmits a shearing force of the inner wall to the outer wall, wherein the shear reinforcement member has an inner end portion fixed to the inner wall, and an outer end portion positioned on at least one brick or between vertically adjacent courses of the bricks and fixed to an upper surface of the at least one brick by a tightening force of the fastener, for transmitting a seismic force acting on the roof and the inner wall to the outer wall by means of the shear reinforcement member.

2. The wall construction as defined in claim 1, wherein the shear reinforcement member has an overall length such that the member extends over the bricks.

3. The wall construction as defined in claim 1, wherein a temporary allowable shear force of the outer wall is in proportion to the prestress applied to the fastener.

4. The wall construction as defined in claim 3, wherein the temporary allowable shear force $Q_{AS}$ of the outer wall is determined by the following formula:

$$Q_{AS}=t\cdot j\cdot\mu\cdot N_P/A$$

wherein t: effective thickness of the wall, j: distance between centers of tension and compression in the wall, $N_P$: total amount of prestress (force) applied to a layer which causes slippage, μ: the coefficient of friction between the brick and a contact surface of a horizontal reinforcement plate, A: effective cross-sectional area of the wall.

5. The wall structure as defined in claim 1, wherein the shear reinforcement member comprises:

a first bracket on a side of the outer wall, the first bracket being located on the brick or between the bricks and being secured to the upper face of the brick by the tightening force of the fastener, and a second bracket on a side of the inner wall side tightly secured to a component of the inner wall, and wherein the brackets on the outer and inner wall sides are connected with each other in a stress transferable condition.

6. A building structure comprising a plurality of wall constructions as defined in claim 1, a roof, and a foundation, wherein the inner wall of each of the wall constructions has an upper end and the roof is supported by the upper ends of the inner walls.

7. A wall construction of a building structure having a roof and a foundation for defining an internal space of the building structure, the wall construction comprising:

a double wall structure of an outer wall and an inner wall, wherein:

the outer wall shares its own dead load and built on the foundation of the structure, the outer wall has sufficient strength for sharing its own dead load and a temporary horizontal load acting on the outer wall and the inner wall, and the outer wall has a Distributed and Unbonded Prestress bricklaying construction in which bricks and metal plates are stacked, the bricks and the metal plates have bolt holes therein, fasteners extend through the bolt holes in the bricks and the bolt holes of the metal plates, and the fasteners are tightened so that vertically adjacent bricks are integrally connected with each other under prestress of the fasteners, each of the metal plates being interposed between the vertically adjacent bricks to be in contact with an upper face of the lower brick and a lower face of the upper brick under the prestress; and the inner wall has sufficient strength for sharing its own dead load and a permanent vertical load acting on the inner wall, wherein the inner wall defines the internal space in conjunction with the roof and the foundation; and a shear reinforcement member connecting the outer and inner walls with each other and made of a metal plate extending along the inner and outer walls and transmitting a shearing force of the inner wall to the outer wall, wherein the shear reinforcement member has an outer end portion positioned on at least one brick or between vertically adjacent courses of the bricks and fixed to an upper surface of the at least one brick by a tightening force of the fastener, for transmitting a seismic force acting on the roof and the inner wall to the outer wall by the shear reinforcement member.

8. The wall construction as defined in claim 7, wherein the shear reinforcement member has an overall length such that the member extends over the bricks.

9. The wall construction as defined in claim 7, wherein a temporary allowable shear force of the outer wall is in proportion to the prestress applied to the fastener.

10. The wall construction as defined in claim 9, wherein the temporary allowable shear force $Q_{AS}$ of the outer wall is determined by the following formula:

$$Q_{AS}=t\cdot j\cdot\mu\cdot N_P/A$$

wherein t: effective thickness of the wall, j: distance between centers of tension and compression in the wall, $N_P$: total amount of prestress (force) applied to a layer which causes slippage, μ: the coefficient of friction between the brick and a contact surface of a horizontal reinforcement plate, A: effective cross-sectional area of the wall.

11. A building structure comprising a plurality of wall constructions as defined in claim 7, a roof, and a foundation, wherein the inner wall of each of the wall constructions has an upper end and the roof is supported by the upper ends of the inner walls.

* * * * *